US010349697B2

(12) United States Patent
Morgan

(10) Patent No.: US 10,349,697 B2
(45) Date of Patent: Jul. 16, 2019

(54) COMPRESSIBLE DAMPING SYSTEM FOR HEAD PROTECTION

(71) Applicant: Donald Edward Morgan, Brisbane (AU)

(72) Inventor: Donald Edward Morgan, Brisbane (AU)

( * ) Notice: Subject to any disclaimer, the term of this patent is extended or adjusted under 35 U.S.C. 154(b) by 22 days.

(21) Appl. No.: 15/223,452

(22) Filed: Jul. 29, 2016

(65) Prior Publication Data

US 2017/0027267 A1 Feb. 2, 2017

(30) Foreign Application Priority Data

Jul. 30, 2015 (AU) ..... 2015903032
Dec. 12, 2015 (AU) ..... 2015905148

(51) Int. Cl.
*A42B 3/00* (2006.01)
*A42B 3/12* (2006.01)
*A42B 3/06* (2006.01)

(52) U.S. Cl.
CPC ..... *A42B 3/128* (2013.01); *A42B 3/062* (2013.01); *A42B 3/065* (2013.01); *A42B 3/124* (2013.01)

(58) Field of Classification Search
CPC ..... A42B 3/128; A42B 3/062; A42B 3/124; A42B 3/063; A42B 3/068; A42B 3/121;
(Continued)

(56) References Cited

U.S. PATENT DOCUMENTS 3,254,883 A 6/1966 Morgan
4,024,586 A * 5/1977 Lamb ..... A42B 3/124 2/414

(Continued)

FOREIGN PATENT DOCUMENTS

CN 203040825 U 7/2013
JP 2007 254920 A 10/2007

(Continued)

OTHER PUBLICATIONS

Motorcycle and Bicycle Protective Helmets: Requirements Resulting from a Post Crash study and Experimental Research, J.P. Corner et al., 1987, Report No. CR 55, Federal Office of Road Safety, Canberra.

(Continued)

*Primary Examiner* — Jameson D Collier
(74) *Attorney, Agent, or Firm* — Gordon & Jacobson, P.C.

(57) ABSTRACT

A system for protecting a head of a wearer from an impact force includes a helmet defining an interior space for housing the head and at least one damper coupled to the helmet at a first end and extending therefrom along a longitudinal axis to a second end. The damper includes of a plurality compressible energy damper elements concentrically arranged about the longitudinal axis. The plurality of compressible energy damper elements includes an outer damper element and an inner damper element. The outer damper element surrounds the inner damper element and extends to the second end of the damper. The outer damper element has a first uncompressed length and the inner element has a second uncompressed length that is different from the first uncompressed length. Alternatively, the plurality of compressible damper elements are concentrically arranged and are arranged end to end in series.

11 Claims, 10 Drawing Sheets

(58) Field of Classification Search
CPC ..... A42B 3/065; A42B 3/125; A42B 3/064; A42B 3/12; A42B 3/14; A42B 3/06
USPC ..... 2/410–414, 416, 425, 909
See application file for complete search history.

(56) References Cited

U.S. PATENT DOCUMENTS

| | | | | |
|---|---|---|---|---|
| 5,204,998 | A | 4/1993 | Liu | |
| 8,060,951 | B2 | 11/2011 | Smith | |
| 8,756,719 | B2 | 6/2014 | Veazie | |
| 8,814,150 | B2 | 8/2014 | Ferrara et al. | |
| 8,955,169 | B2 * | 2/2015 | Weber | A42B 3/125 2/411 |
| 2010/0186150 | A1 * | 7/2010 | Ferrara | A42B 3/128 2/412 |
| 2013/0125294 | A1 * | 5/2013 | Ferrara | A42B 3/064 2/411 |
| 2013/0291289 | A1 * | 11/2013 | Szalkowski | A42B 3/12 2/414 |
| 2013/0340150 | A1 * | 12/2013 | Brantley | A42B 3/121 2/425 |
| 2014/0007322 | A1 | 1/2014 | Marz | |
| 2014/0013491 | A1 * | 1/2014 | Hoshizaki | A42B 3/064 2/411 |
| 2014/0068841 | A1 | 3/2014 | Brown | |
| 2014/0208486 | A1 * | 7/2014 | Krueger | A42B 3/064 2/414 |
| 2015/0052669 | A1 * | 2/2015 | Yoon | A41D 13/015 2/455 |
| 2015/0089724 | A1 * | 4/2015 | Berry | A42B 3/064 2/414 |
| 2015/0305427 | A1 * | 10/2015 | Prabhu | A42B 3/128 2/412 |
| 2016/0021965 | A1 * | 1/2016 | Mayerovitch | A42B 3/12 2/414 |
| 2016/0029730 | A1 * | 2/2016 | Day | F16F 3/04 2/412 |
| 2016/0058092 | A1 * | 3/2016 | Aldino | A42B 3/046 2/412 |
| 2018/0228239 | A1 * | 8/2018 | Day | A42B 3/064 |

FOREIGN PATENT DOCUMENTS

| | | | |
|---|---|---|---|
| KR | 20-0413824 | | 4/2006 |
| KR | 10-1392144 | B1 | 5/2014 |
| WO | WO 2010-001230 | A1 | 1/2010 |
| WO | WO2011/153309 | A2 | 12/2011 |

OTHER PUBLICATIONS

The Influence of Reduced Friction on Head Injury Metrics in Helmeted Head Impacts, John D. Finan et al., 2008, Traffic Injury Prevention, 9:5, 483-488, DOI: 10.1080/15389580802272427.
Head Protection Devices, Bertil Aldman, 1984, The Biomechanics of Impact Trauma, Elsevier Science Publishers B.V., pp. 413-416.
Pathophysiology. In Traumatic Brain Injury, A.L. Halliday, 1999, ed. D.W. Marion, 29-31. New York: Thieme.
Research and Innovation; POC Sports; archived on Dec. 4, 2013 at https://web.archive.org/web/20131204023915/http://www.pocsports.com/en/content/view/protective-concepts.
Introducing MIPS Technology; Bell Helmets; archived on Dec. 17, 2014 at https://web.archive.org/web/20141217134604/http://www.bellhelmets.com/mips.
6D, Advanced Impact Defense; Omni-Directional Suspension, archived on Dec. 19, 2014 at https://web.archive.org/web/20141219001632/http://www.6dhelmets.com/#!ods/c10b6.
Lazer Helmets; Innovation and Technology; SuperSkin; archived on Apr. 11, 2012 at https://web.archive.org/web/20120411071621/http://www.lazerhelmets.com/innovations/superskin/.
Leatt Unveils Helmet Prototypes; Jun. 19, 2014; http://leatt-corp.com/press-releases/leatt-unveils-helmet-prototypes/.
Motoweek; Leatt Corporation, GPX helmet; http://idnmotoweek.blogspot.com/2014_11_30_archive.html; Friday Dec. 5, 2014.
Supplemental EPO Search Report of application No. EP 16 82 9944 dated Apr. 10, 2019.

* cited by examiner

COMPRESSIBLE DAMPING SYSTEM FOR HEAD PROTECTION

CROSS-REFERENCE TO RELATED APPLICATIONS

This application claims priority to Australian Provisional Patent Application No. 2015905148, filed on Dec. 12, 2015 and to Australian Provisional Patent Application No. 2015903032, filed on Jul. 30, 2015, the entire contents of which are hereby incorporated by reference.

BACKGROUND

1. Field

The present application relates to impact protection, and more specifically, to impact protection for the head.

2. State of the Art

An impact to a moving head can cause the skull to rapidly decelerate, while inertia keeps the brain travelling forward to impact the inside surface of the skull. Such impact of the brain against the skull may cause bruising (contusions) and/or bleeding (hemorrhage) to the brain. Therefore, deceleration of the head is an important factor to consider in determining the severity of brain injuries caused by impact to the head.

In all types of impacts to the head, the head is subjected to a combination of linear acceleration and rotational acceleration. Linear acceleration is considered to contribute to focal brain injuries, while rotational acceleration is considered to contribute to both focal and diffuse brain injuries.

Helmets may be used to protect the head from impacts. All helmets add at least some added mass to the head of its wearer. However, adding mass to a helmet can increase the rotational acceleration and deceleration effects to the head and brain as compared to a helmet of a smaller mass.

Protective helmets are used in many environments. In sports, such as football, players wear helmets to protect their heads from repetitive impacts resulting from playing the game. The majority of current technology used in helmets uses foam padding which is only suitable for very low impacts and to provide comfort. Also, such protective helmets using foam padding typically offer only one level of compression, which is only suitable to absorb the impact forces for impacts less than 100 g's.

In addition to foam helmet liners, various other impact protection technologies have been proposed for use in helmets to address linear and/or rotational acceleration. Such technologies include OMNI-DIRECTIONAL SUSPENSION™ (ODS™, in-helmet suspension and kinetic energy management system), MULTIPLE IMPACT PROTECTION SYSTEM® (MIPS®, protective headgear incorporating protective components and fittings), SUPERSKIN® (elastic lubricated membrane), and 360° Turbine Technology.

In a helmet with OMNI-DIRECTIONAL SUSPENSION™ (ODS™) the outer shell and the liner are separated by ODS™ components. However, the ODS™ components add mass and bulk to the helmet. Also, the ODS™ components include hard components adhered to the inside of the outer shell. As a result, the ODS™ system requires the use of a hard and stiff liner to accommodate the hard components. Moreover, there is a possibility of individual ODS™ components detaching due to wear and tear.

In a helmet that incorporates the MIPS®, the helmet includes an outer shell, an inner liner, and a low friction layer. The low friction layer is located on the inside of the foam liner against the head, such that the shock absorbing foam liner is not in direct contact with the head. However, the use of the friction layer and its attachments reduces the ability of the helmet to effectively absorb an impact force. Moreover, MIPS® technology adds mass and bulk to the helmet.

In a helmet with SUPERSKIN®, a layer of a membrane and lubricant is applied to the outer shell of the helmet. The layer reduces friction between the outer shell and the impacting surface thereby reducing angular (rotational) effects on the head and brain.

In a helmet with 360° Turbine Technology multiple circular turbines are located on the inside of the foam liner against the head. While the technology adds minimal mass to the helmet, portions of the turbines may dislodge from wear and tear and, therefore, may not provide protection to the wearer of the helmet during an impact.

With the exception of SUPERSKIN®, the above-mentioned helmet technologies do not take into account the whole thickness and mass of the helmet as a factor in limiting deceleration. Also, the above-mentioned helmet technologies encourage the incorporation of harder and stiffer liners (expanded polystyrene (EPS) foam and other foams). However, harder and stiffer liners may be detrimental to a helmet's effectiveness to absorb translational and angular impact forces.

Additionally, some helmets employ rubber cylinders within a liner of the helmet between the wearers head and an outer skin or shell of the helmet. Such rubber cylinders are configured to have a neutral state in which they contain air. During an impact involving the helmet, the wearer's head compresses the liner and the rubber cylinders, which, when compressed, release the air contained in the cylinder through a valve or opening. After the impact, the cylinders expand and refill with air. However, such air-filled rubber cylinders offer only one level of compression and protection against low impact forces, which is not useful for protecting against more severe impact forces that may be experienced by a wearer of the helmet.

SUMMARY

Impact types may be classified as impacts involving a translational (linear) force and impacts involving a rotational force, which may occur together in an impact or separately. For impacts involving a pure translational force, the helmeted head of the rider undergoes rapid acceleration or deceleration movement in a straight line without rotating about the brain's center of gravity, which is located in the pineal region of the brain. For impacts involving a pure rotational force, the helmeted head undergoes rapid rotational acceleration or deceleration about the brain's center of gravity.

This application relates to improved head protection against repetitive impact forces (or shock). The impact forces may include translational and rotational forces to the head. As used herein, translational forces are those forces resolved in a direction normal or perpendicular to the skull of the head, and rotational forces are those forces resolved in a direction tangential to the skull of the head or perpendicular to the translational forces causing the head to rotate about its center of rotation. In particular, this application relates to head protection systems that include helmets, such as sporting (e.g., football, hockey) and construction helmets, which incorporate compressible energy absorbers to protect against repetitive impact forces to the head.

According to one aspect of the disclosure, a head protection system includes a helmet and at least one compressible energy absorber, hereinafter referred to as a "damper", which is coupled to the helmet to offer protection to a wearer of the helmet against repetitive impact forces. The damper(s) may be coupled to one or more of an outer shell and an inner liner of a helmet. For example, the dampers may be mechanically fastened or adhered to at least one of the interior surface of an outer shell and/or the liner (e.g., expanded polystyrene foam or any other suitable liner materials) of the helmet. The outer shell of the helmet may be hard or soft, such as vinyl outer covering. The dampers may be made of one or more suitable materials, such as silicone rubber.

The damping system is configured to responds to repetitive impact forces (translational and rotational) that are being applied externally to the outer surface of the helmet. The damping system can be incorporated in all types of helmets, including sports helmets and construction helmets. In contrast to the prior art, the dampers described herein provide multiple levels of compression and energy absorption for a wider range of magnitude of impact forces.

According to one aspect, further details of which are described herein, a system for protecting a head of a wearer from an impact force includes a helmet defining an interior space for housing the head, and at least one damper coupled to the helmet at a first end and extending therefrom along a longitudinal axis to a second end. The damper may be comprised of a plurality of compressible energy damper elements concentrically arranged about the longitudinal axis. The plurality of compressible energy damper elements may include at least an outer damper element and an inner damper element, where the outer damper element surrounds the inner damper element and extends to the second end of the damper.

The outer damper element has a first uncompressed length and the inner element has a second uncompressed length that is different from the first uncompressed length.

The first uncompressed length of the outer damper element may be longer than the second uncompressed length of the inner damper element. Also, the plurality of concentrically arranged compressible energy damper elements may include at least one intermediate damper element concentrically arranged between the outer and inner energy damper elements. The at least one intermediate damper element may have a third uncompressed length that is less than the first uncompressed length and greater than the second uncompressed length. The system may include a head stabilizer, which is attached to the outer damper element at the second end of the damper, and which is configured to engage the head of the wearer when the helmet is worn by the wearer.

The system may include a plurality of dampers coupled to the helmet, and the dampers may be arranged in an X-shaped pattern. A portion of the damper may be seated inside one or more openings defined in at least one of an inner liner and an outer shell of the helmet.

The inner damper element may have a free end that is longitudinally spaced between the first and second ends of the damper. The plurality of concentrically arranged compressible energy damper elements may each have a compressible, convoluted cylindrical wall spaced radially from each other. The wall of the inner damper element may be thicker than the wall of the outer damper element. The inner damper element may be a cone having a tip spaced longitudinally between the first and second ends of the damper.

Responsive to an impact force below a predetermined threshold applied to the helmet, the outer damper element may be compressed independently of the inner damper element, and responsive to an impact force above the predetermined threshold applied to the helmet, the outer damper element and the inner damper element may both be compressed.

According to another aspect, further details of which are described herein, a system for protecting a head of a wearer from an impact force includes a helmet defining an interior space for housing the head, and at least one damper coupled to the helmet at a first end and extending therefrom along a longitudinal axis to a second end. The damper may be comprised of a plurality of concentric compressible energy damper elements including at least a first damper element having a first length and a second damper element having a second length, and each energy damper element is arranged end to end along the axis in a serial configuration along the radial direction.

The first damper element may extend from the first end of the damper and the second damper element extends from the second end of the damper, and the first damper element has a first stiffness and the second damper element has a second stiffness different from the first stiffness. The first stiffness may be greater than the second stiffness. The first damper may have a wall thickness that is greater than a wall thickness of the second damper.

According to yet another aspect, a system for protecting a head of a wearer from an impact force includes a helmet defining an interior space for housing the head, and at least one damper coupled to the helmet at a first end and extending therefrom along a longitudinal axis to a second end. The damper is comprised of a plurality of concentric compressible energy damper elements including at least a cylindrical outer damper element and a conical inner damper element surrounded by the outer damper element. The outer damper element has a first uncompressed length and the inner element has a second uncompressed length that is less than the first length.

The conical inner damper element may have a circular base at a first end of the conical inner damper element and have a tip at a second end of the conical inner damper. The cylindrical outer damper has a first end attached to the base of the inner damper and a second end spaced longitudinally from the tip of the inner damper. The conical inner damper element may have a stiffness that is a function of longitudinal position.

DETAILED DESCRIPTION

Figure 1:
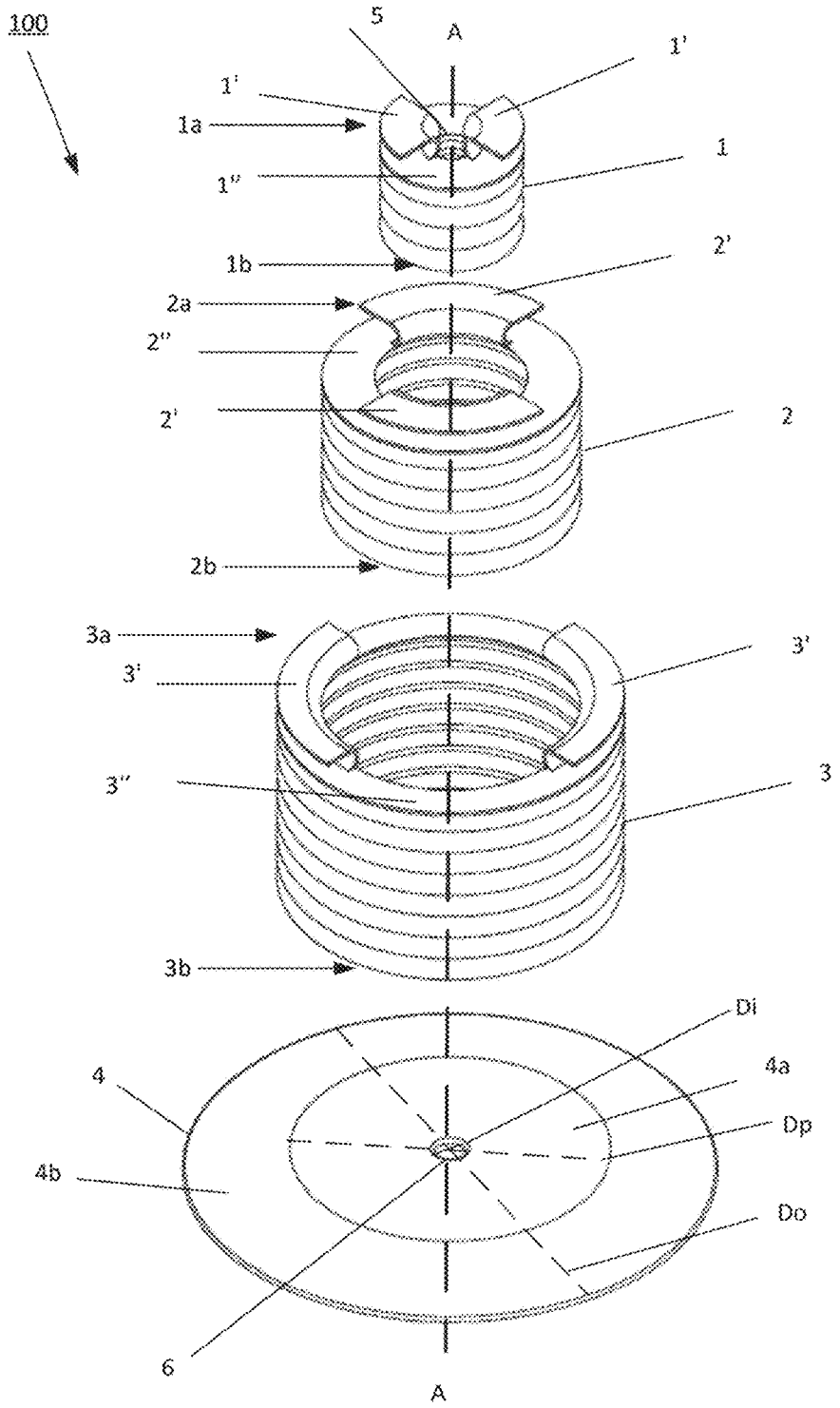
FIG. 1 is an expanded isometric view of an embodiment of an energy absorber or damper, in accordance with an aspect of the present disclosure.

FIG. 1 shows an embodiment of an energy absorber or "damper" 100, which may be coupled to a helmet (e.g., helmet 400, FIG. 4A) in a head protection system (e.g., system 101, FIG. 4A), as described in greater detail below. When such a helmet is placed on a head (e.g., head 103, FIG. 4C) and worn by a user, the user's head is at least partially isolated from the helmet by the dampers 100, which are interposed between the head and the helmet. As described in greater detail below, compression of the dampers 100 helps to decelerate the head during an impact, resulting in a reduction of the impact force and energy transmitted to the head.

Figure 2:
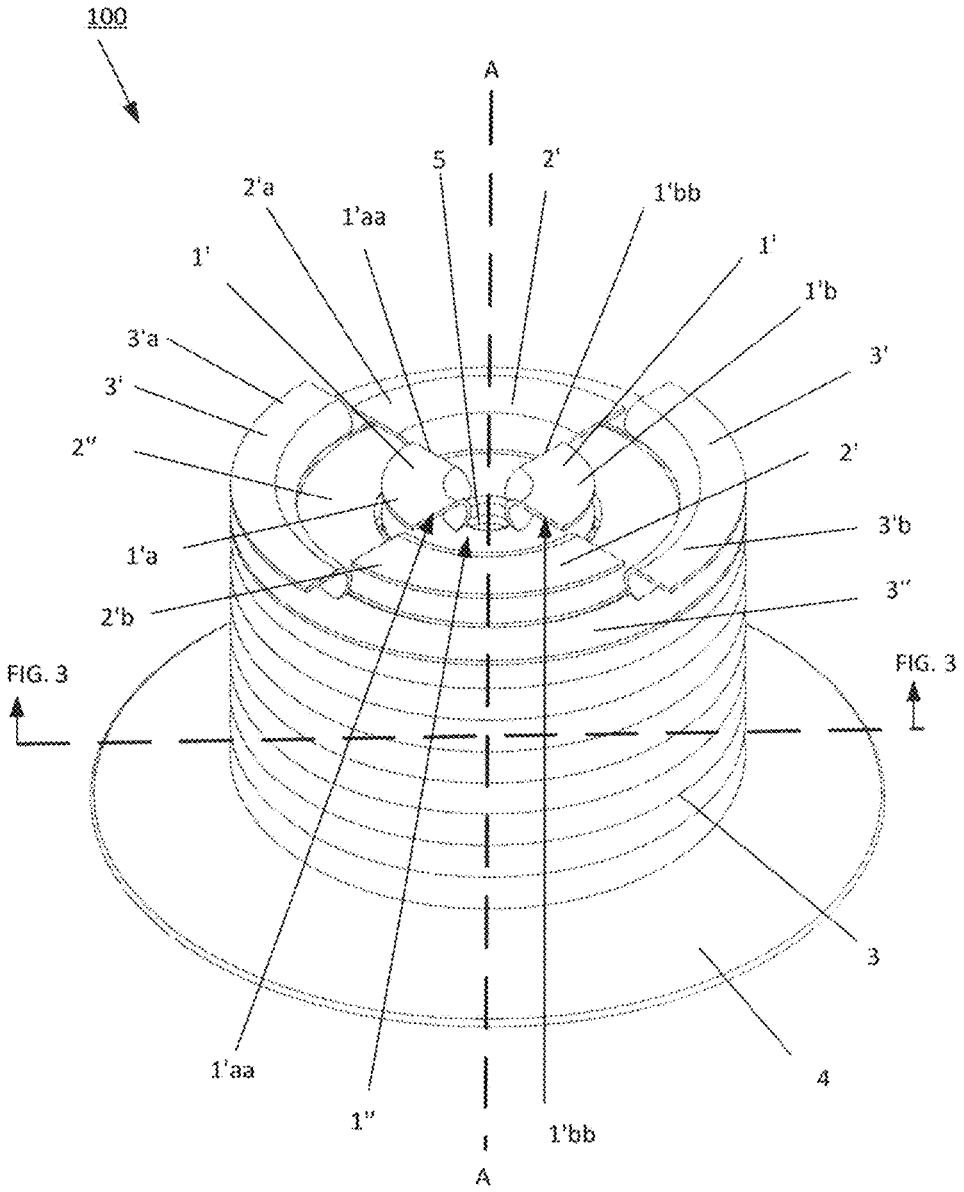
FIG. 2 is an unexpanded isometric view of the damper of FIG. 1.

As shown in FIGS. 1 and 2, the damper 100 includes a plurality of concentrically arranged resilient damper elements 1, 2, and 3 arranged in a nested configuration. For example, as shown in FIG. 1, an inner damping element 1 is concentrically positioned within a middle damping element 2, which is concentrically positioned within an outer damping element 3. The outer damper element 3 has an upper end 3*a* and a lower end 3*b*. The middle damper element 2 has an upper end 2*a* and a lower end 2*b*. The inner damper element 1 has an upper end 1*a* and a lower end 1*b*. A head stabilizer 4 is attached to the lower end 3*b* of the outer damper element 3. The head stabilizer 4 is configured to engage the head (e.g., head 103, FIG. 4C) of a wearer of the helmet 400 of FIG. 4, as will be described in further detail below.

In the example embodiment the damper elements 1, 2, and 3 are all made of one piece and are made from one material, such as silicone rubber, D3O® impact absorbing material, PORON® plastic material, ARMOURGEL™ energy absorbing material or some other suitable material. The density of the damping elements 1, 2, and 3, and head stabilizer 4 may be the same or may be different.

In FIG. 2 the damper 100 is shown in a neutral, uncompressed state. The damper 100 is configured for longitudinal compression and expansion along axis A-A in response to translational impact force application to and removal from the damper 100. The damper 100 is flexible and resilient and is configured to return to the neutral state when external impact forces are no longer applied to the damper 100. In the example embodiment shown in FIG. 2, the lengths of the damper elements 1, 2, and 3, as measured in their neutral state, are different from one another so that the bottom ends 1*b*, 2*b*, and 3*b* of each respective damping element 1, 2, and 3 are longitudinally spaced from each other. Specifically, in the example shown, the length of the damper elements 1, 2, and 3 increases with increasing radial distance away from the axis A-A such that the inner damper element 1 has a first length, the middle damper element 2 has a second length larger than the first length, and the outer damper element 3 has a third length that is larger than both the first and second lengths. The vertical spacing of the bottom ends 1*b*, 2*b*, and 3*b* of the damper elements 1, 2, and 3, provides for various combinations of springs to be compressed based on the magnitude of impact force applied to the damper 100, further details of which will be described in detail below.

Also, the damper 100 is configured for some amount of lateral deflection or swinging motion about axis A-A from the neutral state in response to rotational impact force application to the damper 100. For example, the damper 100 shown in FIG. 4B may deflect in an arc (shown by arrow B) about its point(s) of connection (e.g., between the inside surface of the helmet 400 and lower lips 1", 2", and 3", discussed below) with the helmet 400. The damper 100 is resilient and is configured to return to the neutral state when external impact forces are no longer applied to the damper 100. In the example embodiment shown in FIG. 2, the elements 1, 2, and 3 are radially spaced from one another, with the outer damper element 3 having the largest diameter and the inner damper element 1 having the smallest diameter. The radial spacing of the damper elements 1, 2, and 3 provides the damper 100 with some rigidity to resist lateral deflection and prevent kinking of the damper elements 1, 2, and 3. Specifically, when the damper is progressively compressed from the neutral position, the head stabilizer 4 will successively engage the middle damper element 2 and then the inner damper element 1. When the middle damper element 2 is engaged, the area moment of inertia of the damper 100 is effectively increased as compared to the stiffness of the outer damper element 3 alone. Also, when the inner damper element 1 is engaged along with the middle damper element 2 and the outer damper element 3, the area moment of inertia of the damper 100 is effectively further increased. Thus, in other words, the multiple annular damper elements 1, 2, and 3 can, in combination, increase the flexural rigidity of the damper 100 so that it will laterally deflect less under the same bending moment.

As shown in FIG. 2, each damper element 1, 2, and 3 includes a corresponding upper lip 1', 2', and 3' and lower lip 1", 2", and 3" that are joined together at a radially inner curved wall 1''', 2''', and 3'''. One or more of the upper lip 1', 2', and 3', corresponding lower lip 1", 2", and 3", and corresponding curved wall 1''', 2''', and 3''' may be adhered, fused, or otherwise coupled to the outer shell 401 of the helmet 400 (FIG. 4B) or to a liner 502 (FIGS. 5A, 5B) on the inside of the outer shell of the helmet. Alternatively, where the damper 100 is adhered to the inside surface of the helmet 400 the damper 100 may be formed without upper lips 1', 2', and 3' and without inner curved walls 1''', 2''', and 3'''. In such a case, lower lips 1", 2", and 3" are formed for attachment (i.e., adhesive attachment) to the inside surface of the outer shell 401 of the helmet 400 or to a liner (e.g., liner 402) inside the shell.

In the specific embodiment shown in FIG. 2, each of the lower lips 1", 2" and 3" is formed as an annulus while corresponding upper lips 1', 2', and 3' are formed as arcuate annular segments spaced vertically above their corresponding lower lips 1", 2" and 3". For example, upper lip 1' includes a pair of diametrically opposed upper lip segments 1'*a* and 1'*b*. The upper lip segments 1'*a* and 1'*b* are longitudinally spaced along axis A-A from annular lower lip 1" by curved wall 1". As shown in FIG. 2, the middle damper element 2 and outer damper element 3 may have the same construction of the upper and lower lips as damper element 1. The upper lip 1', lower lip 1", and curved wall 1'" define a set of circumferential groove segments which may be configured to receive and seat in corresponding arcuate slots (not shown) in an outer shell (e.g., shell 401) of a helmet (e.g., helmet 400). Such a mechanical fastening may be used alone or additionally with adhesive to couple the damper 100 to the helmet. Also, the lower lips 1", 2", and 3" may be adhered or attached to an inner side of an outer shell (e.g., outer shell 401, FIG. 4B) of a helmet (e.g., helmet 400, FIG. 4B) or to an inner liner (e.g., liner 502, FIG. 5A) of a helmet (e.g., helmet 500, FIG. 5A).

The upper lip segments of each upper lip 1', 2', and 3' are circumferentially spaced ninety degrees from one another so that each upper lip segment covers one quarter of the area of their corresponding lower lip. For example, as shown in FIG. 2 the angle subtended by side edges 1'*aa* of upper lip 1'*a* is about ninety degrees and the angle subtended by side edges 1'*bb* of upper lip 1'*b* is about ninety degrees. As shown in FIG. 2, the middle damper element 2 and outer damper element 3 may have the same construction of their upper and lower lips as damper element 1.

Also, the upper lip segments of each damper element 1, 2, 3, are oriented ninety degrees about the axis A-A with respect to the upper lip segments of other damper elements. For example, the upper lip 2' of the middle damper element 2 includes lip segments 2'*a* and 2'*b* which are oriented so that they are rotated ninety degrees with respect to lip segments 1'*a* and 1'*b*. Also, the upper lip 3' of the outer element 3 includes lip segments 3'*a* and 3'*b* are rotated ninety degrees with respect to lip segments 2'*a* and 2'*b*.

Figure 3:
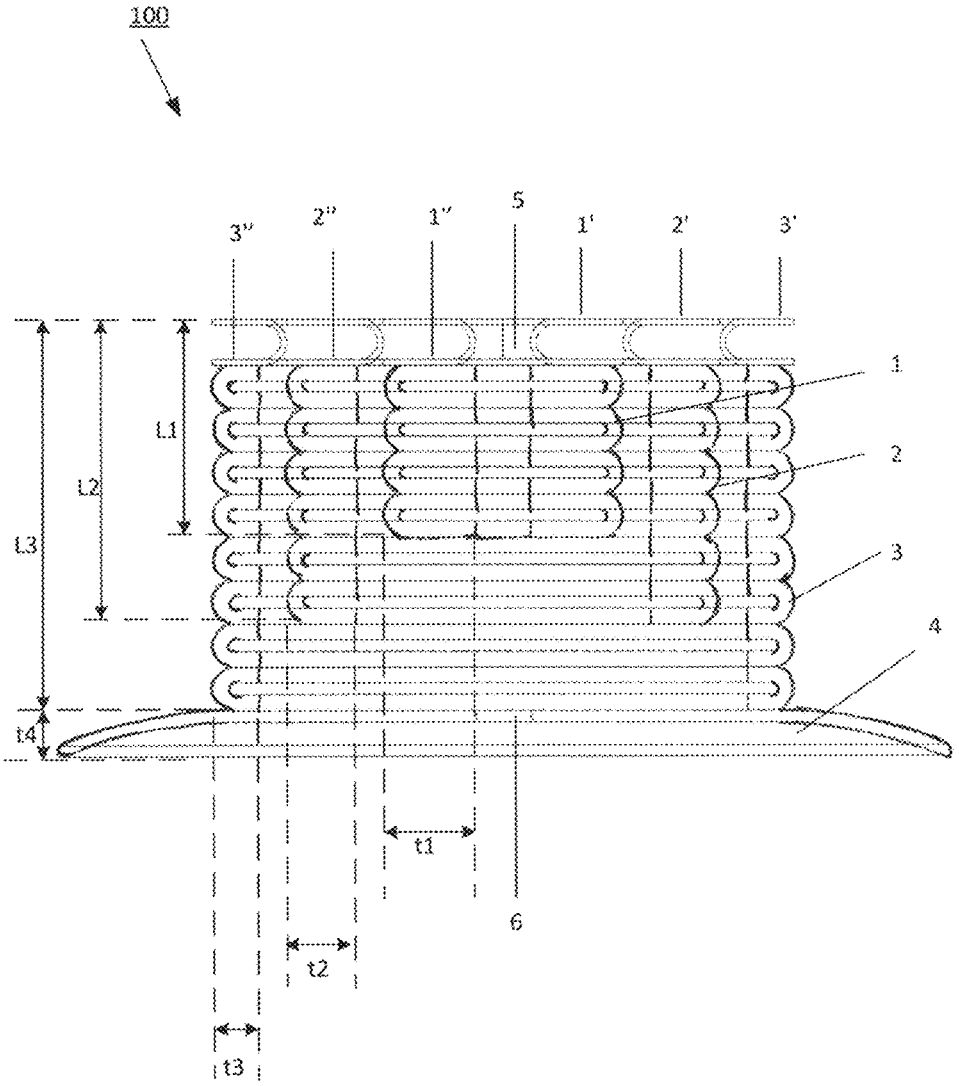
FIG. 3 is a view of the damper of FIG. 2 along section 3-3 in FIG. 2.

As shown in the example in FIG. 3, the damper elements 1, 2, and 3 have a convoluted or pleated wall, which is compressible and resilient, as noted above. The amount of compressibility (or stiffness) exhibited by each damper element 1, 2, and 3 may be based on the thickness of the wall of the respective damper element, the number of damper convolutions, and the material properties (e.g., density) of the damper element. The differences in stiffness among the damper elements and their longitudinally spaced relationship allows for different levels of resistance to impact forces to be progressively activated based upon the magnitude of the impact force.

The convoluted wall resembles a tubular bellows. In the example shown in FIG. 3, the inner damper element 1 has four convolutions, the middle damper element 2 has six convolutions, and the outer damping element 3 has eight convolutions. The outer and inner diameters of inner damper element 1 are about 20.67 mm and 4.67 mm respectively, the outer and inner diameters of inner damper element 2 are about 37.33 mm and 25.33 mm respectively, and the outer and inner diameters of outer damper element 3 are about 50.0 mm and 42.0 mm respectively. Thus, in the example, a wall thickness t1 of the inner damper element 1 is about 8 mm, a wall thickness t2 of the middle damper element 2 is about 6 mm, and a wall thickness t3 of the outer damper element 3 is about 4 mm. Accordingly, in the example, the ratio of wall thicknesses t1:t2:t3 is: 8:6:4 (or 4:3:2). Also, with regard to the example, in the neutral state of the damper shown in FIG. 2, the length L3 of outer damper element 3 is about 30 mm+/−5 mm, the length L2 of middle damper element 2 is about 22.5 mm+/−5 mm, and the length L1 of inner damper element 1 is about 15 mm+/−5 mm. Therefore, as you progress from the outer damper element 3 to the inner damper element 1 there is an increase in the wall thickness of each damper element, a decrease in height, and an increase in longitudinal and lateral stiffness.

Turning back to FIG. 1, the head stabilizer 4 has a generally planar circular inner portion 4*a* centered about axis A-A and a generally concave outer portion 4*b* concentrically surrounding the inner portion 4*a*. The inner portion 4*a* of the head stabilizer 4 defines a central hole 6. In one example, a diameter $D_i$ of the hole 6 is about 4.67 mm, an outer diameter $D_p$ of the inner planar portion 4*a* is about 46.84, and an outer diameter $D_o$ of the outer concave portion 4*b* is about 76.84 mm. As shown in FIG. 3, the hole 6 aligns with hole 5 (which also has a diameter of about 4.67 mm) along axis A-A.

Figure 4A:
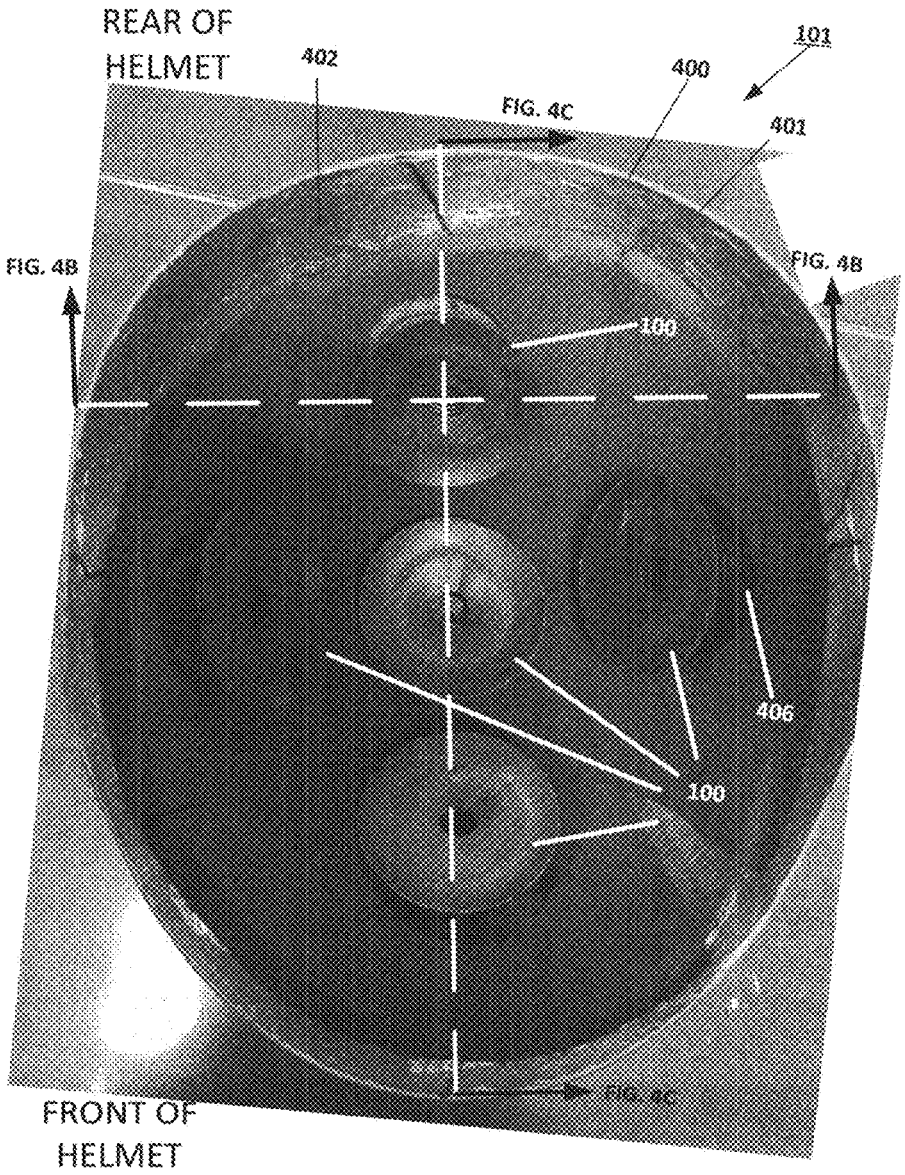
FIG. 4A is a view of an inner side of a helmet in which a plurality of dampers of FIGS. 1 and 2 are incorporated, in accordance with an aspect of the present disclosure.

FIG. 4A illustrates the aforementioned head protection system 101 that includes the helmet 400 and at least one damper 100 that is coupled to the helmet 400. For example, in the embodiment shown in FIG. 4A, a plurality of five dampers 100 are coupled to the helmet 400 and extend inwardly along a longitudinal direction from a first end attached to the helmet to a free end at the head stabilizer 4. The dampers 100 shown in FIG. 4A are distributed in an "X" pattern as follows: one damper located at the center (corresponding to the location of the crown of the head of a wearer of the helmet), one damper at a front position, one damper at a right position, one damper at a left position, and one damper at a rear position. The helmet 400 may include a hard outer shell 401 and one or more liners 402 (e.g., a compressible foam liner) coupled to the inner side of the outer shell 401. For example, for helmet 400 the outer shell 401 may be made from a thin outer polyvinyl chloride (PVC) or fiberglass and/or carbon and the liner 402 may be made from expanded polystyrene (EPS) or ethylene-vinyl acetate (EVA) in-molded to the PVC shell. The helmet 400 may have a comfort liner 402*a* (not shown in FIG. 4A, but shown in FIGS. 4B and 4C) on an inner side of the liner 402 and may be made from EVA or some other suitable material for comfort. When the helmet 400 is worn by a user, as shown in FIG. 4C, for example, the inner concave side of the head adjuster 4 is configured to engage a head 103 of a user.

Figure 4B:
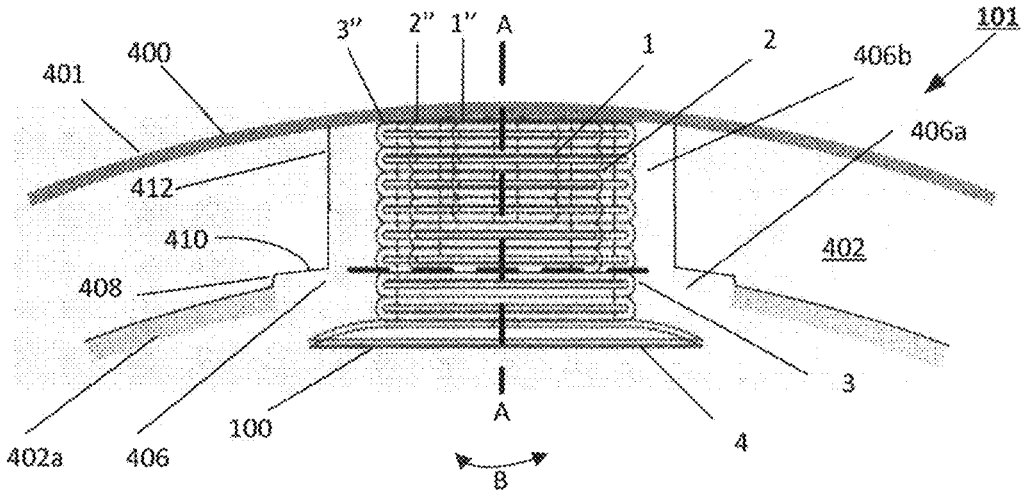
FIG. 4B is a view of the helmet and dampers of FIG. 4A along section 4B-4B in FIG. 4A.

FIG. 4B shows a view of the system 101 along section 4B-4B in FIG. 4A. An opening 406 is formed in the liner 402 and comfort liner 402*a* in which the damper 100 is disposed. The damper 100 extends concentrically within the opening 406 along longitudinal axis A-A. Specifically, the lower lips 1", 2", and 3" of the damper elements 1, 2, and 3, are attached (e.g., adhesively) to an inner surface of the outer shell 401. In the neutral state shown in FIGS. 4A and 4B, the head stabilizer 4 extends just below and in spaced relation to a comfort liner 402*a*.

The stepped opening 406 shown in FIG. 4B is defined by a first tapered portion 406*a* and a second cylindrical portion 406*b*. The first portion 406*a* is defined by a frustoconical surface 408 having a first diameter at the inner side 402*a* of the liner 402 and having a second, smaller diameter, at an annular shoulder 410. The first diameter is larger than the diameter of the head stabilizer 4. The annular shoulder 410 extends radially inwardly from the frustoconical surface 408 to a cylindrical surface 412 of the second portion 406*b* of the opening 406. The cylindrical surface 412 extends longitudinally along axis A-A from the annular shoulder 410 to the outer shell 401. The diameter of the cylindrical surface 412 is less than the second diameter of the frustoconical surface 408. The length of the second portion 406*b*, measured longitudinally along axis A-A, from the outer shell 401 is about the same as the length L2 of the middle damper element 2.

Figure 4C:
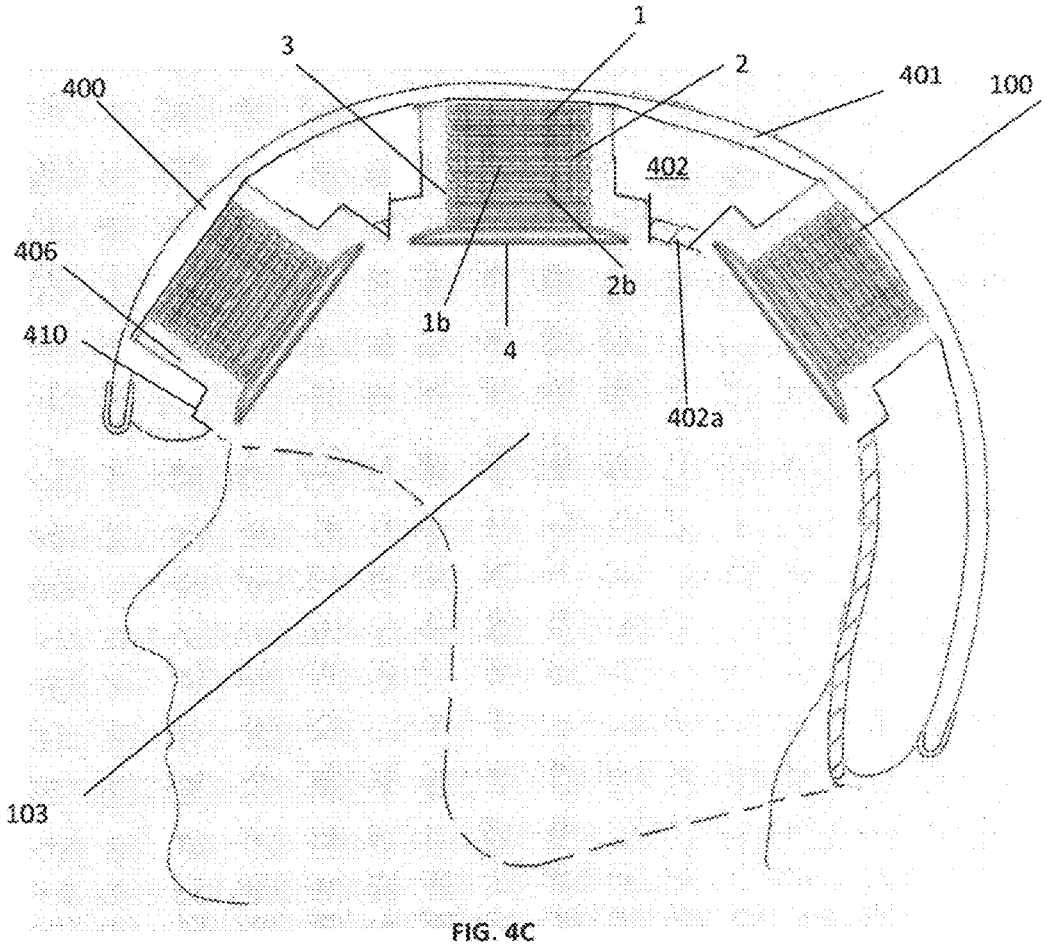
FIG. 4C is a view of the helmet and dampers of FIG. 4A along section 4C-4C in FIG. 4A when worn by a user.

As shown in FIG. 4C, when the helmet 400 is placed on the head 103 of a wearer and the head stabilizers 4 are engaged with the head 103, the outer damper 3 will be partially compressed, and the head stabilizer 4 will engage (and possibly slightly compress) the middle damper element 2, while remaining spaced from the shoulder 410. Since the head stabilizer 4 is engaged with the middle damper element 2 when the helmet is placed on the head 103, the area moment of inertia of the damper 100 is automatically increased as compared to when the helmet 400 is not worn on the head (e.g., FIG. 4A). As a result, when the helmet 400 is placed on the head 103, the damper 100 is initially laterally and longitudinally stiffened and may become even stiffer when the head stabilizer 4 engages inner damper element 1 as described above.

In an impact between the helmet 400 and an object the user's head 103 will move with the head stabilizers 4 relative to the outer shell 401 of the helmet 400, causing corresponding longitudinal and/or lateral movement of the head stabilizer 4 and compression and/or flexure of the damper 100. Due to the direct connection of the head stabilizer 4 to the outer damper element 3 and the vertical spacing between the ends 1*b*, 2*b*, and 3*b* of the damper elements 1, 2, and 3, the damper elements 1, 2, and 3 compress sequentially as described above. Depending on the magnitude of the impact forces (translational and rotational) and the stiffness of the damper elements 1, 2, and 3, two (outer and middle damper elements 3 and 2) or all of the damper elements 1, 2, and 3 may longitudinally compress and/or flex laterally.

For example, initially when the helmet is on the head 103, if the head stabilizer 4 is longitudinally deflected in response to a sufficiently large impact force, the head stabilizer 4 will apply forces to the liner 402 at the shoulder 410, as well as the outer and middle damper element 3 and 2. Specifically, initially following an impact, the outer damper element 3 and the middle damper element 2 distribute the impact force according to their respective stiffnesses such that both the outer damper element 3 and the middle damper element 2 will deflect together the same amount with the head stabilizer 4. Moreover, when the head 103 is engaged with the head stabilizer 4, as shown in FIG. 4C, translational and rotational impact forces will cause the damper 100 to initially bend (transverse to axis A-A) owing to relative translational movement between the outer shell 401 of the helmet 400 and the head stabilizer 4.

Initially following the impact, the translational and rotational impact forces will cause the outer damper element 3 and the middle damper element 2 to compress based on their respective stiffnesses and will flex laterally based on the thickness, number of convolutions, and radial spacing between damper elements 1, 2, and 3. It will be appreciated that the head 103 extends beyond the outer diameter Do of the head stabilizer 4 and engages the inner surface of the comfort liner 402*a* around the bore 406 when the helmet 4 is worn. Therefore, whenever the damper 100 compresses from the position shown in FIG. 4C, the comfort liner 402*a* and the liner 402 will also tend to absorb some of the force of the impact due to engagement of the head 103 with the liners 402*a* and 402, and, therefore, the liners 402*a* and 402 will also distribute some of the impact force in parallel with the damper 100.

If the magnitude of the impact forces are large enough, the head stabilizer 4 may compress the outer damper element 3 and middle damper element 2 and move longitudinally along axis A-A to engage and compress the liner 402 at the shoulder 410, and. When the liner 402, and the middle and outer damper elements 2 and 3 are compressed, their combination effectively increases the stiffness of the damper 100, and, therefore, the damper will experience a decrease in longitudinal deflection when exposed to the same forces. Also, when the liner 402, and the outer and middle damper elements 3 and 2 are engaged with the head stabilizer 4, the damper 100 exhibits an increased lateral stiffness and, therefore, will experience a decrease in lateral deflection if exposed to the same lateral forces. If the magnitude of the rotational and translational impact forces are large enough, the head stabilizer 4 may continue moving towards and engage the lower end 1*b* of the inner damper element 1, so that all of the damper elements 1, 2, and 3 and the liner 402 are compressed by the head stabilizer 4 to absorb the energy of the impact and decelerate the head relative to the helmet 400. When the combination of the damper elements 1, 2, and 3 and liner 402 are compressed, the combination will compress, but with a further increase in stiffness of the damper 100 and a further decrease in the amount of deflection as compared to when only the middle and outer damper elements 2 and 3 are engaged. Also, when all of the damper elements 1, 2, and 3 are engaged and compressed, the damper 100 exhibits a further decrease in lateral movement as compared to when only damper elements 2 and 3 are engaged.

The compression of the liner 402 and the damper elements 1, 2, and 3 results in the absorption of energy as a result of the damper elements performing work (Work=Force×distance). The energy absorbed reduces the transmission of the impact force to the user's head, thereby assisting in reducing the severity of the impact to the wearer's head. In one embodiment, the outer damper element 3 is configured to absorb impacts up to 100 g's, the outer damper element 3 and middle damper elements 2 are designed to take impacts up to 200 g's. The combination of all three damper elements 1, 2, and 3 are designed to absorb impacts up to about 250 g's+/−50 g's.

The system 101 of FIG. 4A was comparatively tested against skiing and bicycle helmets. The parameters of the test include a 100 cm drop height and an impact speed of about 4.5 m/sec (15.7 km/hr). One bicycle helmet ("*Bicycle 2 helmet in Table 1, below) that was tested was designed to address rotational acceleration/deceleration impacts. The comparative data is shown below in Table 1.

TABLE 1

| | Type of Helmet | | | | |
|---|---|---|---|---|---|
| | Helmet 1 mass = 675 g | Helmet 2 mass = 670 g | Skiing mass = 600 g | Bicycle 1 mass = 260 g | *Bicycle 2 mass = 300 g |
| Rotational acceleration/ deceleration (rad/s$^2$) | 2698 | 2361 | 3508 | 5114 | 4071 |
| Maximum Peak G | 85 | 78 | 90 | 86 | 84 |
| Maximum Angular velocity (rad/s) | 10.6 | 12.4 | 11.9 | 18.3 | 14.4 |

Helmets 1 and 2 were constructed in accordance with the present disclosure. Specifically, both Helmet 1 and Helmet 2 have an outer shell made of fiberglass and carbon, do not include an expanded polystyrene foam liner, include a 10 mm comfort layer made of EVA, incorporated five dampers 100 as shown in FIG. 4A adhered to the inner surface of the outer shell. Also, the dampers 100 used in Helmet 1 and Helmet 2 have wall thicknesses having a ratio of 8:6:4, as described above with respect to the example of damper 100. The dampers 100 used were wholly made of silicone rubber having a density of 1.03 g/L. As shown above in Table 1, the tested Helmet 1 and Helmet 2 produces the lowest rotational acceleration and deceleration. The differences in mass listed in Table 1 are due to the presence and number of vent holes in the helmets: Helmet 1 and 2 had no vents, Skiing helmet had a small area of vent openings, and Bicycle 1 and 2 had a relatively larger overall area of vent openings.

Figure 5A:
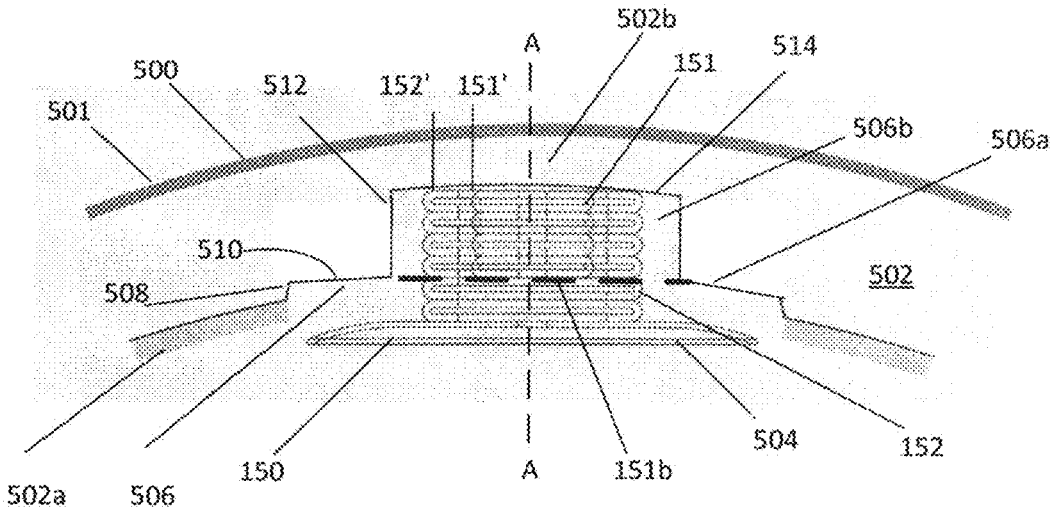
FIG. 5A is a section view of a portion of a helmet and another embodiment of a damper coupled to the helmet.

FIG. 5A illustrates an alternative helmet 500 to helmet 400 in FIGS. 4A to 4C. Specifically, the helmet 500 incorporates a damper 150, which is a modified version of damper 100, which substitutes two damper elements 151 and 152 for the three damper elements 1, 2, and 3 of damper 100. Otherwise, the damper elements 151 and 152 may have the same construction as described above in connection with damper elements 1, 2, and 3. Also, the helmet 500 includes a liner 502, which is similar in construction to that of liner 402, but differing in the construction of opening 406. Specifically, the liner 502 defines a countersunk depression 506 rather than opening 406, such that the damper 150 attaches to the liner 502 rather than to an outer shell 501 of the helmet 500. As shown in in FIG. 5A, when the helmet is not placed on the head 103 of a wearer and the stabilizers 504 are disengaged from the head 103, the stabilizer 504 is spaced longitudinally from liner 502*a*. Also, a compressible portion 502*b* of the liner 502 is interposed between the damper 150 and the outer shell 501. The portion 502*b* thus acts as an additional damper element in parallel with the entire damper 150. The depression 506 includes a first portion 506*a* and a second portion 506*b*. The first portion 506*a* is defined by a frustoconical surface 508 having a first diameter at an inner side 502*a* of the liner 502 and having a second, smaller diameter, at an annular step 510. The annular shoulder 510 extends radially inwardly from the frustoconical surface 508 to a cylindrical surface 512 of the second portion 506*b*. The cylindrical surface 512 extends from the annular step 510 to a bottom 514 of the depression 506. The diameter of the cylindrical surface 512 is less than the second diameter of the frustoconical surface 508. In the embodiment shown in FIG. 5A, the annular step 510 is aligned with the lower end of the inner damper element 151. When the helmet 500 is placed on the head 103 and the head stabilizer 504 engage the head 103, the stabilizer 504 will compress the outer damper element 152 and engage and/or slightly compress a lower end 151*b* of the inner damper element 151. The damper elements 151 and 152 will function in similar manner as damper elements 3 and 2 of damper 100, except that the head stabilizer 504 will not engage a third damper element inside damper element 151. Instead, the portion of the liner 502*b* between the damper 150 and the outer shell 501 is continually used to distribute impact forces in series with the damper 150 and that portion 502*b* compresses based on the stiffness of the liner material. Thus, during an impact, a portion of the impact force will be transmitted to the liner 502 both at the shoulder 510 and in portion 502*b*, as well as to the damper 150, which will compress respective amounts based on distribution of the forces therebetween.

Figure 5F:
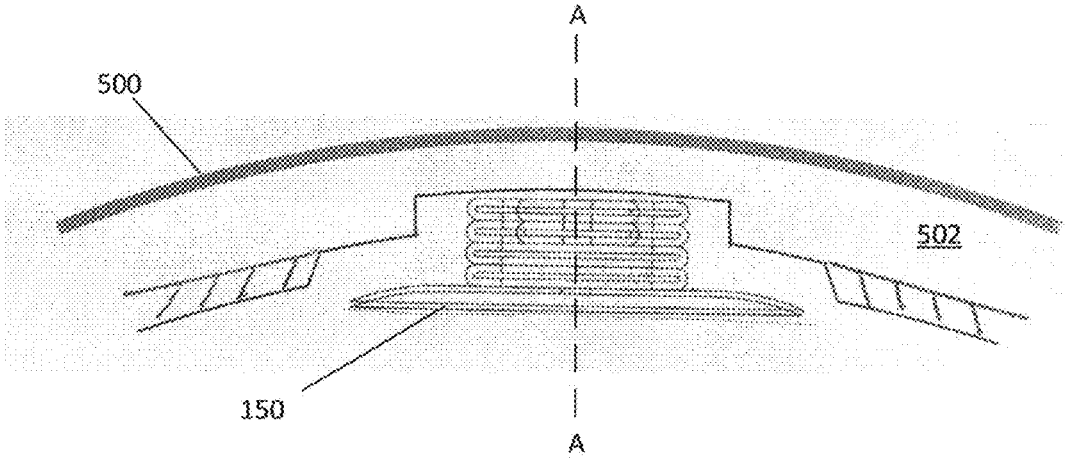
FIG. 5F illustrates the helmet and damper of FIG. 5A with a thinner helmet construction and shorter damper.
Figure 5B:
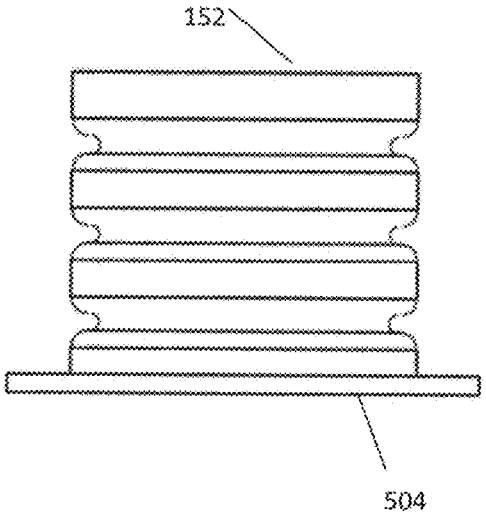
FIG. 5B is a side elevation view of an outer damper element of the damper shown in FIG. 5A.
Figure 5D:
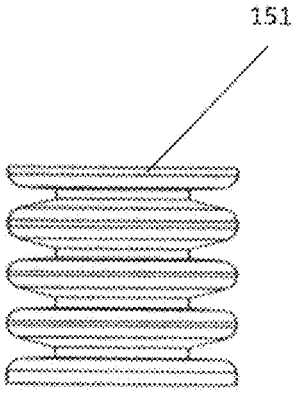
FIG. 5D is a side elevation view of an inner damper element of the damper shown in FIG. 5A.
Figure 5C:
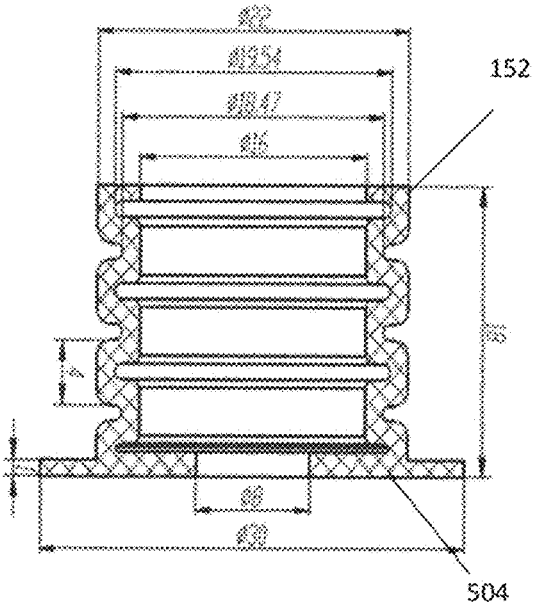
FIG. 5C is a view of the outer damper element of FIG. 5B along a center section thereof.

FIGS. 5B and 5C show details of outer damper element 152. By way of example, the outer damper element 152 may have a convoluted wall having an outer diameter of 22 mm and an inner diameter of 16 mm. The wall of the outer damper may have convolutions that are 4 mm thick. The head stabilizer 504 may have an outer diameter of about 30 mm and an inner diameter of about 8 mm.

Figure 5E:
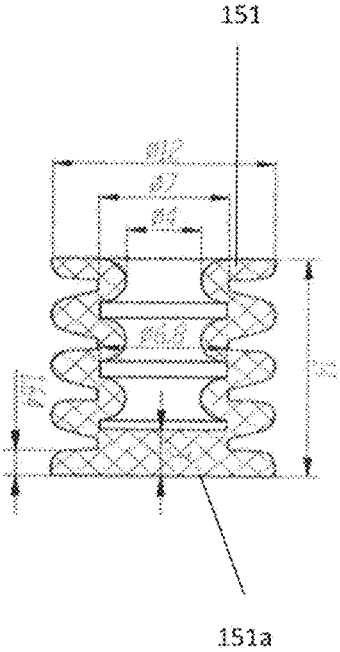
FIG. 5E is a view of the inner damper element of FIG. 5D along a center section thereof.

FIGS. 5D and 5E show details of the inner damper element 151. The inner damper element 151 may have a convoluted wall having an outer diameter of about 12 mm and an inner diameter of about 4 mm. The wall of the inner damper element have convolutions that are about 3.5 mm thick. A lower end 151*a* of the inner damper element is shown as a solid closed flange having a thickness of about 3 mm. Thus, owing to the dimensions of the inner and outer damper elements 151 and 152 of the example shown in FIGS. 5C and 5E, there is a radial spacing of about 2 mm between the inner and outer damper elements 151 and 152.

FIG. 5F illustrates a lower-profile alternative embodiment to that shown in FIG. 5A in which the liner 502 is thinner (in the axial dimension along axis A-A) than in FIG. 5A and the length of the damper 150 along axis A-A is less than in FIG. 5A.

Figure 6:
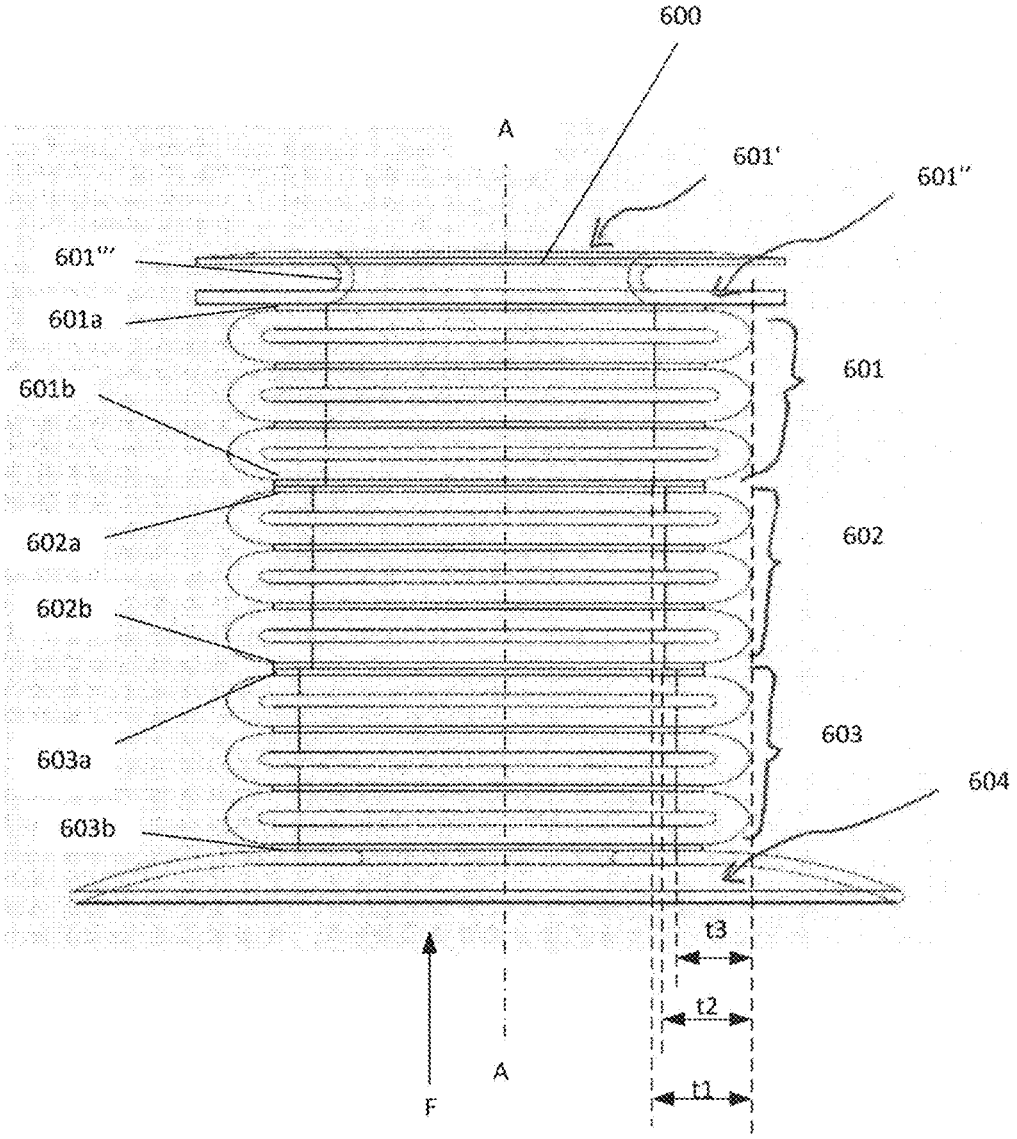
FIG. 6 is a center section view of another embodiment of a damper in accordance with an aspect of the disclosure.

FIG. 6 shows a cross-section of another embodiment of a damper 600, which includes three circular damper elements 601, 602, and 603, and a head stabilizer 604 attached to the damper element 603. The damper elements 601, 602, and 603 are arranged end-to-end in a serial configuration along axis A-A. In FIG. 6 the damper 600 is shown in its neutral (i.e., fully uncompressed) state. In one embodiment, lower damper element 603 is attached to a middle damper element 602, which is attached to upper damper element 601. The damper element 603 has a lower end 603*b* that is attached to the head stabilizer 604 and has an upper end 603*a* that is attached to a lower end 602*b* of the middle damper element 602. The middle damper element 602 has an upper end 602*a* that is attached to a lower end 601*b* of the upper damper element 601. The upper damper element 601 has an upper annular lip 601' and a lower annular lip 601" that define an annular groove 601'" at an upper end 601*a* of the upper damper element 601. The annular groove 601'" may have the same function as the groove described above, i.e. to receive and seat with an outer shell of a helmet, such as shell 401 of helmet 400. It will be appreciated, however, that the outer shell 401 of the helmet 400, for example, may be modified to define a fully circular hole having a diameter that is slightly smaller than the diameter of the annular groove 601'" so that the annular groove is seated in the hole in the shell 401 of the helmet 400. Also, the upper lip 601' may be adhered or otherwise attached to the outer shell or a liner of the helmet in the same manner described above for upper lips 1', 2', and 3' of damper 100.

Each damper element 601, 602, and 603 in FIG. 6 has a convoluted wall with three convolutions per damper element. In the example shown in FIG. 6, the height of all convolutions along axis A-A are the same. Of course, the number of convolutions and the dimensions may be different in other embodiments depending on the materials and/or wall thicknesses of each damper element. The damper elements 601, 602, and 603 and head stabilizer 604, may all be made from the same material, such as silicone rubber. The lower damper element 603 has a wall thickness t3 that is less than a wall thickness t2 of the middle damper element 602. The upper damper element 601 has a wall thickness t1 that is larger than the wall thicknesses t2 and t3. All factors being equal among damper elements 601, 602, and 603, damper elements with a thicker wall are stiffer than damper elements with a thinner wall. Thus, in a case where the damper elements 601, 602, and 603 are made of the same material (e.g., silicone rubber), and the number of convolutions and convolution height are the same (as in the example in FIG. 6), the upper damper element 601 has the largest wall thickness t1 and, therefore, is the stiffest of the damper elements 601, 602, and 603. Also, the lower damper element 603 has the thinnest wall thickness t3 and, therefore, is the least stiff (most compressible) of the damper elements 601, 602, and 603. Thus, all factors being considered equal (except for wall thickness), the stiffness of the damper elements 601, 602, and 603 increases in a direction along axis A-A from the lower damper element 603 to the upper damper element 601. The progression in stiffness of the damper elements 601, 602, and 603 permits the damper to respond with increasing stiffness for larger impact forces, and to gradually decelerate the head of the wearer of a helmet incorporating the damper 600.

The damper elements 601, 602, and 603 are arranged like springs connected in series. An impact force F, applied in the direction of the arrow shown in FIG. 6, will be transmitted to all of the damper elements 601, 602, and 603, which will each compress an amount based on their stiffness. In one embodiment the damper elements 601, 602, and 603 are modeled as Hookean (linear-response springs) arranged in series, where each spring has a respective spring constant, so that the applied force is directly proportional to compression of the spring, as related below:

$$F = F_1 = F_2 = F_3 \quad (1)$$

$$-k_1x_1 = -k_2x_2 = -k_3x_3 \quad (2)$$

$$\frac{k_1}{k_2} = \frac{x_2}{x_1};\ \frac{k_2}{k_3} = \frac{x_3}{x_2};\ \frac{k_3}{k_1} = \frac{x_1}{x_3} \quad (3)$$

Thus, when an impact force F is applied to the damper 600 it will be transmitted to each damper element 601, 602, and 603, causing the stiffer (larger spring constant, $k_1$) damper element 601 to compress less than damper element 603, which has a smaller spring constant, $k_3$. Nevertheless, each damper element 601, 602, and 603, will compress a respective amount based on their corresponding spring constant and the total deflection of the head stabilizer will be equal to the sum of the compression of each damper element 601, 602, and 603.

As noted above, the damper 600 may directly replace damper 100 in helmet 400, for example. In such an embodiment, the upper lip 601' is connected to the outer shell 401 of the helmet 400 and head stabilizer 604 will be positioned in place of head stabilizer 4 in FIG. 4C. In an impact between the helmet and an object, the impact force F will be transmitted, and the user's head will move relative to the outer shell 401 of the helmet 400, causing corresponding movement of the head stabilizer 604, which is engaged with the wearer's head, and compression of the damper 600. Depending on the magnitude of the translational impact force F and the compressibility of the damper elements 601, 602, and 603, and the liner 402, one or more of the damper elements 601, 602, and 603 may become fully compressed. The compression of the damper elements 601, 602, and 603, partially or wholly, absorbs energy of the impact and slows the transmission of the impact force to the user's head, thereby facilitating a reduction of the severity of the impact to the wearer's head. The material employed and the values selected for compressibility or stiffness for each damping device 601, 602, and 603 is such that it allows the damper 600 to carry out its desired effect in absorbing repetitive impact forces including translational and rotational impact forces.

Figure 7A:
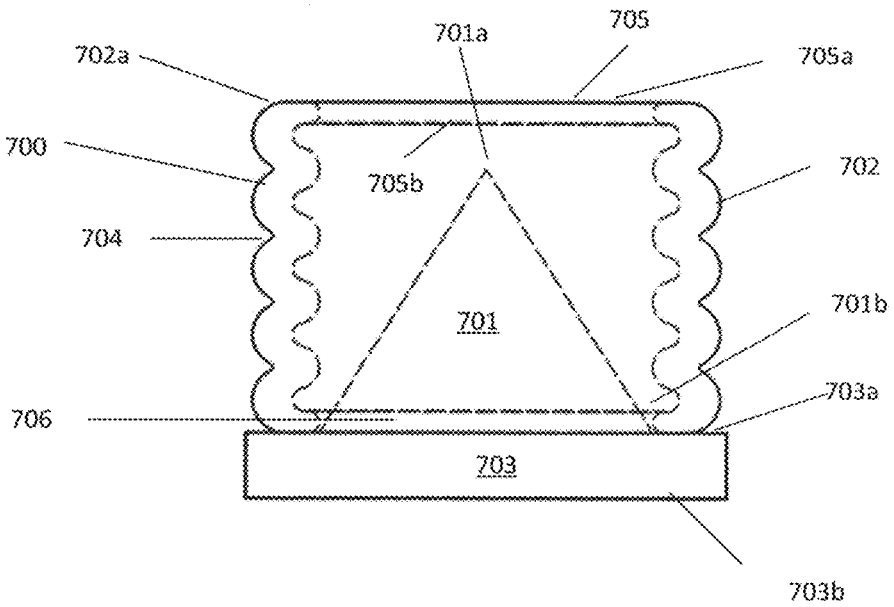
FIG. 7A is a center section view of another embodiment of a damper, in accordance with an aspect of the disclosure.
Figure 7B:
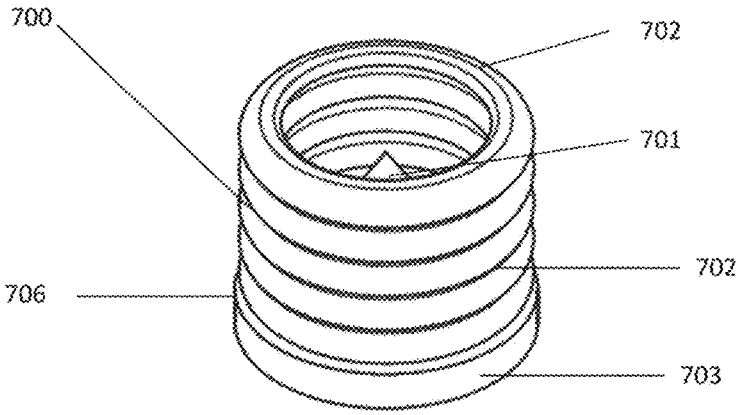
FIG. 7B is an isometric view of the damper of FIG. 7A with a cover removed for clarity of illustration.
Figure 8A:
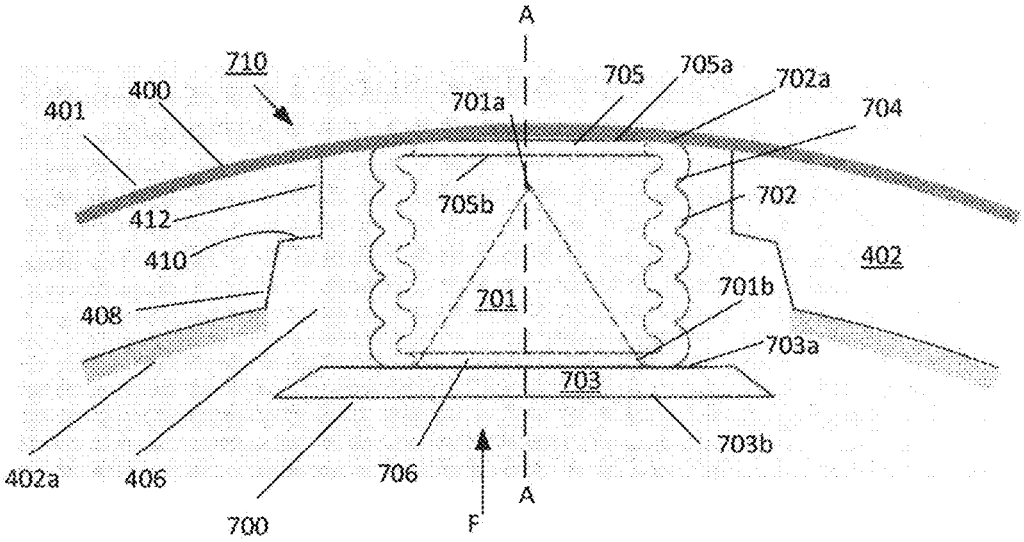
FIG. 8A illustrates the damper of FIG. 7A coupled to a helmet.
Figure 8B:
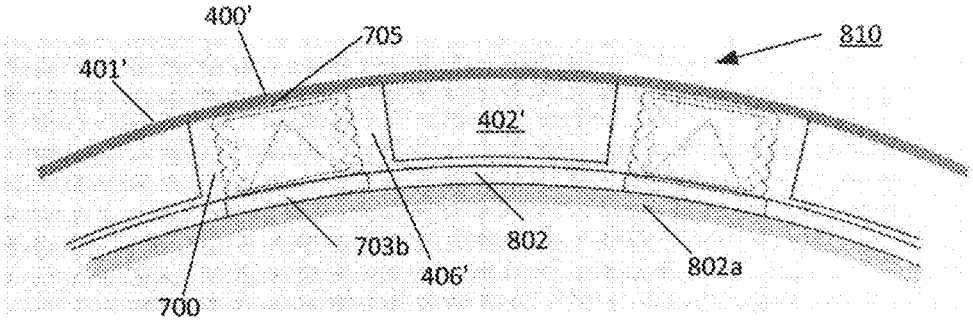
FIG. 8B illustrates the damper of FIG. 7A incorporated into another helmet.

FIGS. 7A and 7B illustrate another embodiment of a damper 700 that may be incorporated in to a helmet, such as helmet 400' shown in FIG. 8A. The damper 700 includes a compressible cone 701, concentrically arranged along longitudinal axis A-A inside a cylindrical compressible element 702. The compressible element 702 may be a spring or a flexible convoluted tube. The damper 700 also includes a base 703, which is connected to the cone 701 and the compressible element 702. The cone 701 has a tip 701*a* and a circular base 701*b* longitudinally spaced along the axis A-A from the tip 701*a*. The compressible element 702 has a generally cylindrical wall 704, which may be smooth or convoluted, that extends from an attached circular base 706 to an attached circular cover 705 (which is omitted for clarity of illustration in FIG. 7B). The circular base 701*b* of the cone 701 and the circular base 706 of the compressible element 702 are fused or adhered to an upper surface 703*a* of the base 703. As shown in FIG. 8B, the base 703 can also be part of a portion of a liner 402 of certain thickness and made of the same material as the cone 701 and the compressible element 702. Also, the base 703 may take the form of head stabilizer 4, described above. As shown in FIG. 8A, the tip 701*a* of the cone 701 is longitudinally disposed along axis A-A between the cover 705 and the base 706 of the compressible element 702.

The damper 700 may be made wholly or partially of silicone rubber with the cone 701, the compressible element 702, and the base 703 all having the same density or different densities. Alternatively, the material forming the damper 700 may include at least one of PORON®, ARMOURGEL®, D3O®, expanded thermoplastic urethane (ETPU) and other suitable materials.

In one example of the damper 700, the base 701*b* of the cone 701 has a diameter of about 25.0 mm; the cone 701 has a height of about 20.0 mm; the circular base 703 has a thickness of about 5.0 mm; the circular base 706 has a diameter of about 36.0 mm; the damper element 702 has an inner diameter of about 25.0 mm and an external diameter of about 30.0 mm (the wall 704 has a thickness of about 5.0 mm); the damper element 702 has a longitudinal uncompressed length of about 25.0 mm; the height of each damping coil (if a coil spring is used as damping element 702) or convolution (if a convoluted element is used as damper element 702) of the damping element 702 is about 5.0 mm. Such an example damper 700 may absorb impacts up to 300 g's.

The compressibility of the damper 700 may be based on the geometry and material properties of the damper 700. For example, the compressibility of the cone 701 may be based on the geometry and of the material properties (e.g., density) of the cone 701. In the case of cone 701 formed of one uniform material, due to the tapered profile of the cone, the compressibility of the cone 701 decreases along the axis A-A from the tip 701*a* of the cone 701 to the base 701*b* of the cone 701. Thus, as the cone 701 is longitudinally compressed by a force, the force will be resisted by progressively stiffer (less compressible) cone 701.

On the other hand, the compressibility of element 702 may not be a function of position along axis A-A. Instead, the compressible member 702 may exhibit a uniform compressibility with increasing compression, in similar manner to a linear, Hookean spring that has a spring constant. The compressibility of element 702 may be based on the thickness of the wall 704, the number of damping coils (if the compressible element 702 is a coil spring) or convolutions (if the compressible element 702 is convoluted), and the material(s) forming the compressible element 702 (e.g., silicone). The material(s) used and the values selected for compressibility or stiffness for each portion of the damper 700 are selected to allow the damper 700 to absorb repetitive impact forces including translational and rotational impacts.

The damper 700 may be integrated into various types of sports helmets (e.g., for football, hockey, surfing, water-sports, cycling, skiing, skating, horse riding, rodeo riding, gymnasium) as well as helmets used by construction workers and emergency personnel. FIG. 8A shows a system 710 that includes the damper 700 incorporated into the helmet 400, described in detail above. As shown, the base 703 may take the form of the above-described head stabilizer 4 and may be separate from the liner 402. The circular cover 705 of the compressible element 702 may be adhered or fused to an inner side of the outer shell 401 of the helmet 400. Also, the circular cover 705 may be omitted and an upper edge 702*a* of the compressible element 702 may be fused directly to the inner side of the outer shell 401 of the helmet 400. When the damper 700 is used in the helmet 400, a lower or inner side 703*b* of the base 703 is configured to engage a head of a wearer of the helmet so that when placed on the head 103 in the manner shown in FIG. 4C, the base 703 will be flush with the comfort liner 402*a*, while remaining spaced from the shoulder 410. Also, when base 703 is flush with comfort liner 402*a*, the tip 701*a* of the cone will be in compression with the cover 705 (or if the cover 705 is omitted, the tip 701*a* of the cone 701 engages and compresses against the inside surface of the outer shell 401 of the helmet 400.

During an impact between the helmet 400 and an object, rotational and translational impact forces are directed towards the head causing the damper 700 and liner 402 to compress. In the example shown in FIG. 8A, a translational force "F" is shown. At the same time the head is travelling in the opposite direction (Newton's third law of motion—equal and opposite forces) causing the head to compress the base 703 of the damper 700, which, in turn, compresses the compressible element 702, causing the cone 701 to move longitudinally along axis A-A towards the cover 705 due to the connection of the cone 701 to the base 703 and compress further. If the impact force F is sufficiently large, the compressible element 702 and cone 701 continue to compress along with the liner 402 (due to eventual engagement of the base 703 with the shoulder 410) When both the element 702 and the cone 701 both undergo compression, they will both distribute the impact force in parallel. However, due to the non-uniform compressibility of the cone 701, noted above, when the impact force causes both the spring 702 and the cone 701 to undergo compression, as the cone 701 compresses it will become progressively stiffer and, thus, absorb more of the impact force. As a result, the head that is engaged with the base 703 may be gradually decelerated to reduce the magnitude of forces transmitted to the head.

FIG. 8B shows a system 810 that includes a helmet 400', similar to helmet 400 of FIG. 8A, and having a liner 402' (e.g., made of EPS) that defines openings 406' that have a uniform cylindrical wall. Also, the system 810 includes dampers 700 attached to an inner side of an outer shell 401' of the helmet 400'. The system 810 further includes an additional liner 802 (e.g., made of the same material as outer damper element 702 and cone 701, such as D3O®) that is spaced from the liner 402' but is connected between the bases 703*b* of dampers 700. Also, the system 810 includes a comfort liner 802*a* (e.g., made of EVA) that conforms and attaches to an inner side of the liner 802. The liner 402' may be made of either EPS or may be the same material as liner 802 or some other suitable material. By joining the bases 703*b* of the dampers 700 together, the dampers are further flexurally stiffened to withstand rotational impact forces.

Figure 8C:
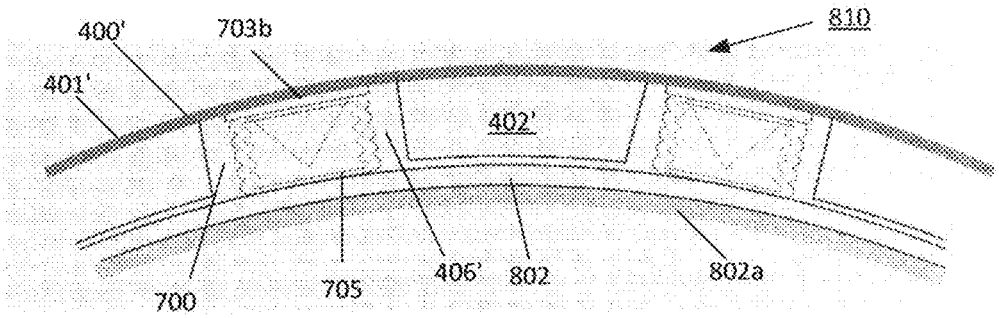
FIG. 8C illustrates the damper of FIG. 7A incorporated into another helmet.

FIG. 8C shows an alternate system 810' to system 810 in which the dampers 700 are oriented reverse to those shown in FIG. 8B. Specifically, the dampers 700 have an inverted orientation in helmet 400' such that for each damper 700 the base 703*b* is connected to the outer shell 401 of the helmet 400 and the covers 705 is connected to the liner 802.

The systems 810 and 810' shown respectively in FIG. 8B and FIG. 8C can represent a head-band protector with the outer shell 401' being made of vinyl material. In one example, the system 810 shown in FIG. 8B may be configured as a head band in which the liner 802, bases 703*b*, and cones 701 are made of one-piece material (D3O®). Also, the outer damper elements 702 are formed separately (and may also be made of D3O®) are joined (e.g., adhered/glued) to the outer shell 401' (e.g., made of vinyl) and the circular bases of 702 are joined (e.g., adhered/glued) to the liner 802 to receive and/or enclose the cones 701. In such an example, the liner 402 may also be made of the same material as the liner 802, bases 703*b*, cones 701, and outer damper elements 702 (e.g., D3O®) or a different suitable material.

Also, in another example, the system 810' shown in FIG. 8C may be configured as a head band in which the liner 802 and outer damper elements 702 are made of one piece material (e.g., D3O®) and the circular opening top piece of 702 are joined (e.g., adhered/glued) to 703*b* to receive or enclose the cones 701. In this example, the cones 701 (including bases 703*b*) may be formed separately and joined (e.g., adhered/glued) to the outer shell 401' (e.g., made of vinyl).

Further, in the systems 810 and 810', if the liner 402' is made of EPS, then the outer shell 401' may be made from PVC (plastic) or fiberglass/carbon. Specifically, in one example, the outer shell 401' is made of fiberglass/carbon or PVC, the liner 402' is made of EPS, and the liner 802 and the damper elements (701 and 702) are made of D3O, silicon rubber, or some other suitable material.

There have been described and illustrated herein several embodiments of a head protection system. While particular embodiments of the invention have been described, it is not intended that the invention be limited thereto, as it is intended that the invention be as broad in scope as the art will allow and that the specification be read likewise. Thus, while particular damper arrangements have been disclosed, it will be appreciated that other arrangements may be used as well. In addition, while particular types of materials have been disclosed for the dampers, it will be understood that other suitable materials can be used. It will therefore be appreciated by those skilled in the art that yet other modifications could be made to the provided invention without deviating from its spirit and scope as claimed.

What is claimed is:

1. A system for protecting a head of a wearer from impact forces, the system comprising:

a helmet defining an interior space for housing the head; and a plurality of dampers coupled to the helmet and extending into the interior space, wherein each damper has a first end and a second end, each damper extending from the first end to the second end along a respective longitudinal axis, the first end being coupled to the helmet and the second end being disposed in the interior space, wherein each damper is comprised of a head stabilizer at the second end in the interior space and a plurality of compressible energy damper elements coupled to the head stabilizer and disposed between the first end and the head stabilizer, the plurality of compressible energy damper elements being concentrically arranged about the respective longitudinal axis, the head stabilizer being configured to directly contact the head, wherein for each damper, the plurality of compressible energy damper elements includes a radially outer damper element and a radially inner damper element, the radially inner damper element being concentrically surrounded by the radially outer damper element, the radially outer damper element being radially spaced from the radially inner damper element, the radially outer damper element having a longitudinally inner end directly connected to the head stabilizer, the radially inner damper element having a longitudinally inner end that is longitudinally spaced from the longitudinally inner end of the radially outer damper element, wherein the longitudinally inner ends of the radially inner and outer damper elements are configured for deflecting relative to one another in longitudinal and radial directions, wherein in a relaxed configuration of the respective damper element, the longitudinally inner end of the radially inner damper element is longitudinally spaced away from the head stabilizer, and wherein the head stabilizers are capable of moving relative to one another in the interior space.

2. The system according to claim 1, wherein:

the radially outer damper element has a first uncompressed length and the radially inner damper element has a second uncompressed length that is different from the first uncompressed length, and the first uncompressed length of the radially outer damper element is longer than the second uncompressed length of the radially inner damper element.

3. The system according to claim 2, wherein:

the plurality of concentrically arranged compressible energy damper elements includes at least one radially intermediate damper element concentrically arranged between the radially outer and inner damper elements, and wherein the at least one radially intermediate damper element has a third uncompressed length that is less than the first uncompressed length and greater than the second uncompressed length.

4. The system according to claim 2, wherein:

the radially inner damper element has a free end that is longitudinally spaced between the first and second ends of each damper.

5. The system according to claim 4, wherein:

each of the plurality of concentrically arranged compressible energy damper elements has a compressible, convoluted cylindrical wall spaced radially from one another.

6. The system according to claim 5, wherein:

the wall of the radially inner damper element is thicker than the wall of the radially outer damper element.

7. The system according to claim 4, wherein:

the radially inner damper element of each damper is a cone having a tip at the free end.

8. The system according to claim 7, wherein:

the conical radially inner damper element has a stiffness that is a function of longitudinal position along the conical radially inner damper element.

9. The system according to claim 2, wherein:

the radially outer damper element is configured to compress independently of the radially inner damper element due to an impact force below a predetermined threshold applied to the helmet, and the radially outer damper element and the radially inner damper element are configured to both compress in response to an impact force above the predetermined threshold.

10. The system according to claim 1, wherein:

the plurality of dampers are arranged in an X-shaped pattern.

11. The system according to claim 1, wherein:

a portion of each damper is seated inside one or more openings defined in at least one of an inner liner and an outer shell of the helmet.

* * * * *